US005576166A

United States Patent [19]

Sugita et al.

[11] Patent Number: 5,576,166

[45] Date of Patent: Nov. 19, 1996

[54] SILVER HALIDE LIGHT-SENSITIVE COLOR PHOTOGRAPHIC

[75] Inventors: Shuichi Sugita; Shinri Tanaka; Takatugu Suzuki; Manabu Kaneko, all of Hino, Japan

[73] Assignee: Konica Corporation, Japan

[21] Appl. No.: 484,448

[22] Filed: Jun. 7, 1995

[30] Foreign Application Priority Data

Jun. 9, 1994 [JP] Japan ..... 6-127691

[51] Int. Cl.[6] ..... G03C 7/384

[52] U.S. Cl. ..... 430/555

[58] Field of Search ..... 430/555

[56] References Cited

U.S. PATENT DOCUMENTS

| | | | |
|---|---|---|---|
| 4,199,361 | 4/1980 | Furutachi | 430/555 |
| 4,476,219 | 10/1984 | Sakamone et al. | 430/555 |
| 4,584,266 | 4/1986 | Hirose et al. | 430/555 |
| 5,350,667 | 9/1994 | Singer et al. | 430/555 |
| 5,376,519 | 12/1994 | Merkel et al. | 430/555 |

FOREIGN PATENT DOCUMENTS

| | | | |
|---|---|---|---|
| 2034842 | 2/1990 | Japan | 430/555 |
| 5-150421 | 6/1993 | Japan . | |
| 1552701 | 9/1979 | United Kingdom | 430/555 |

OTHER PUBLICATIONS

Anilinopyrazolon–Farbkuppler, Research Disclosure, vol. 351, No. 1, pp. 434–435.

Hackh's Chemical Dictionary, 4th Ed., pp. 34, 35 and 131.

*Primary Examiner*—Lee C. Wright

*Attorney, Agent, or Firm*—Jordan B. Bierman; Bierman and Muserlian

[57] ABSTRACT

A silver halide light-sensitive color photographic material is disclosed. A green-sensitive silver halide emulsion layer of the material comprises a coupler the formula M-I or formula M-II defined in the specification, and the color photographic material provides enhanced sensitivity and excellent color reproduction property when it is printed, and improved resistance against formalin gas and storage preservation property before exposure.

6 Claims, No Drawings

SILVER HALIDE LIGHT-SENSITIVE COLOR PHOTOGRAPHIC

FIELD OF THE INVENTION

The present invention relates to a silver halide light-sensitive color photographic material. To be more specific, the present invention relates to a silver halide light-sensitive color photographic material, which has enhanced sensitivity and improved color reproduction property, improved resistance against formalin gas and preservation under storage before exposure.

BACKGROUND OF THE INVENTION

Presently, a subtractive tri-primary color process has been employed in the silver halide light-sensitive color photography, and a color image is formed from the combination of three dye images reduced from a yellow dye-forming coupler, a magenta dye image-forming coupler and a cyan dye image-forming coupler.

As the conventional magenta dye image-forming coupler used in the conventional silver halide light-sensitive photographic materials, pyrazolone-type, pyrazolinobenzimidazole-type and indanone-type couplers are known and, among them, various kinds of 5-pyrazolone derivatives are used widely.

As for the substituent at 3-position of the 5-pyrazolone cycle of the above-mentioned 5-pyrazolone derivative, for example, alkyl group, aryl group, alkoxy group disclosed in U.S. Pat. No. 2,439,098, acylamino group disclosed in US. Pat. Nos. 2,369,489 and 2,600,788, and ureide group disclosed in U.S. Pat. No. 3,558,319. However, coupling activities of these couplers with the oxidation product of a developing agent is relatively low. and, therefore, there have been defects that it is difficult to obtain a magenta dye image with high density, that the magenta dye image obtained by color development has a large secondary absorption in the blue light region and that sharpness of the absorption spectrum of the main absorption of the dye image on the long wavelength side is not very clear.

A 3-anilino-5-pyrazolone type coupler as disclosed in U.S. Pat. Nos. 2,311081, 3,677,764 and 3,684,514; British patents No. 956,261 and No. 1,173,513 have an advantage that the coupling activity is high, that they can give high density image and that unnecessary absorption in the red-light region is small, however, since the primary absorption of the conventionally known 3-anilino-5-pyrazolone-type coupler resides relatively in the short wavelength region and, therefore, when they are used in the negative-type silver halide light-sensitive photographic materials, color reproduction property is deteriorated.

For the purpose improving these defects, various attempts have been made and, for example, a 1-pentahalogenophenyl-3-anilino-5-pyrazolone-type coupler has been proposed in Japanese Patent O.P.I. Publication No. 52-80027(1977). This type of coupler has high coupling reactivity, being capable of giving high density image and having excellent spectroscopic property, however, there is a defect that when the coupler is stored in the presence of formalin gas, image density is lowered.

Further, it has been clarified that the light-sensitive material which comprises this type of pyrazolone-type coupler has a problem that photographic properties can easily change. In recent years, industrial demand for the improvement of the photographic properties of the silver halide light-sensitive photographic material has become increasingly stricter and commercial goods which have homogeneous property between lots or with lapse of time during storage. Still more, with realization of silver-saving or thin-layered silver halide light-sensitive color photographic materials, fluctuation of the photographic properties during storage tend to be large and, therefore, development of silver halide light-sensitive color photographic materials with less fluctuation in the photographic properties with the lapse of time, or photographic materials having improved preservation property before exposure during storage have strongly been demanded.

SUMMARY OF THE INVENTION

The first object of the present invention is to provide a silver halide light-sensitive color photographic material which has enhanced sensitivity and excellent color reproduction properties in the printing process.

The second object of the present invention is to provide a silver halide light-sensitive color photographic material which has improved resistance against formalin gas.

The third object of the present invention is to provide a silver halide light-sensitive color photographic material which has improved preservation properties during storage before exposure.

The other object in addition thereto those mentioned above is to provide a magenta coupler used in a silver halide light-sensitive color photographic material which has an improved color developability or high maximum density.

The silver halide light-sensitive color photographic material of the invention comprises a support and, provided thereon, a blue-sensitive silver halide emulsion layer, a green-sensitive silver halide emulsion layer and a red-sensitive silver halide emulsion layer, wherein the green-sensitive silver halide emulsion layer comprises at least one coupler represented by the following general formula M-I or M-II;

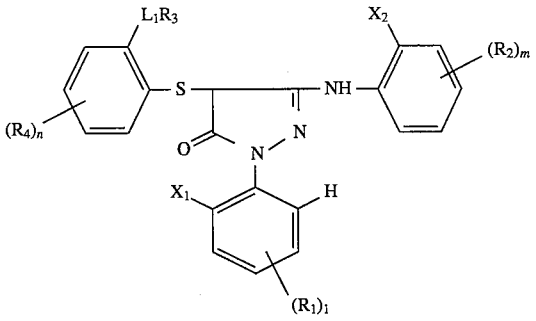

In the formula, $R_1$ represents a substituent of which σp value is not less than 0.3; $R_2$ represents a group selected from the group consisting of an amide group, an amido group, a sulfonamide group, an imide group, a carbamoyl group, a sulfamoyl group, an oxycarbonyl group, an oxycarbonylamino group and a ureide group. $R_3$ represents a group selected from the group consisting of an alkyl group, an aryl group, and a heterocyclic group; $R_4$ represents a group which can be substituted on a benzene ring; $X_1$ represents a halogen atom; $X_2$ represents a halogen atom or an alkoxy group; $L_1$ represents an atom or a group selected from the group consisting of an oxygen atom, a sulfur atom, a —$NR_5$ group, a —$SO_2$ group, a —$NR_5CO$— group, a —COO— group, a —$NR_5SO_2$— group, a —NHCOO— group and a —$NR_5CONR_5$— group; $R_5$ represents a hydrogen atom, an alkyl group, an aryl group, or a heterocyclic group; l represents an integer of one, two or three; and m and n independently represent an integer of zero to four.

M-II

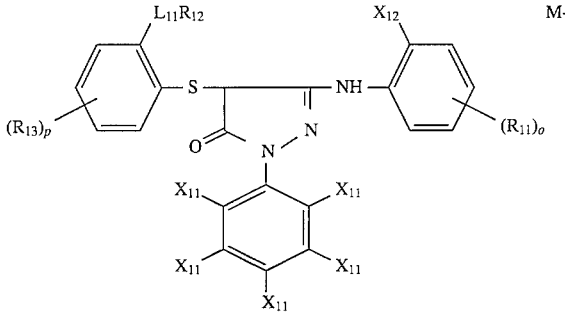

In the formula, $R_{11}$ represents a group selected from the group consisting of an amide group, an amido group, a sulfonamide group, an imide group, a carbamoyl group, a sulfamoyl group, an oxycarbonyl group, an oxycarbonylamino group and a ureide group, each of which has not more than 10 carbon atoms; $R_{12}$ represents a group selected from the group consisting of an alkyl group, an aryl group, and a heterocyclic group; $R_{13}$ represents a group which can be substituted on a benzene ring; $X_{11}$ represents a halogen atom; $X_{12}$ represents a halogen atom or an alkoxy group; $L_{11}$ represents an atom or a group selected from the group consisting of an oxygen atom, a sulfur atom, a —$NR_{14}$ group, a —$SO_2$ group, a —$NR_{14}CO$— group, a —COO— group, a —$NR_{14}SO_2$— group, a —NHCOO— group and a —$NR_{14}CONR_{14}$— group; $R_{14}$ represents a hydrogen atom, an alkyl group, an aryl group, or a heterocyclic group; o represents an integer of one, two or three; and p represents an integer of zero to four.

DETAILED DISCLOSURE OF THE INVENTION

The magenta dye-forming coupler represented by the abovementioned general formulae M-I and M-II is explained.

In the above-mentioned general formula M-1, $R_1$ represents a substituent of which σp value (disclosed in Hansch, C. J., Med. Chem., 1973, 16, 1207 and Hansch, ibid. 1977, 20, 304) is not less than 0.3. The substituent includes, for example, a cyano group, a trifluoromethyl group, a carbonyl group, an oxycarbonyl group, a sulfonyl group, a carbamoyl group, a sulfamoyl group, a nitro group and a carbonyloxy. The preferable examples include a cyano group, an alkylsulfonyl group, a phenylsulfonyl group, a trifluoromethyl group, an alkyloxycarbonyl group, a phenyloxycarbonyl group, an alkylsulfonyl group and a nitro group.

The preferable $R_2$ is an amide group, whose examples are a propanoylamino group, a butanoylamino group, a pentanoylamino group, a pivaloylamino group, a hexanoylamino group, a heptanoylamino group, an ethanesulfonamide group, a butanesulfonamide group, a hexanesulfonamide group, a p-toluenesulfonamide group, a succineimide group, a butylaminocarbonyl group, a pentylaminosulfonyl group, a hexyloxycarbonyl group and a pentyloxycarbonylamino group.

$R_3$ represents a group selected from the group consisting of an alkyl group, an aryl group, and a heterocyclic group. The preferable example is an alkyl or aryl group which may have a substituent. Number of carbon atom of $R_3$ is preferably 12. Preferable example includes

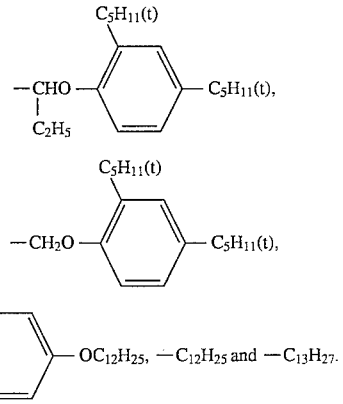

The group represented by $R_4$, which is substitutable on the benzene ring includes, for example, an alkyl group, a cycloalkyl group, an alkenyl group, an aryl group, an acylamino group, a sulfonamide group, an alkylthio group, an arylthio group, a halogen atom, a heterocyclic ring, a sulfonyl group, a sulfinyl group, a phosphonyl group, an acyl group, a carbamoyl group, a sulfamoyl group, a cyano group, an alkoxy group, an aryloxy group, a heterocyclicoxy group, a xyloxy group, an acyloxy group, a carbamoyloxy group, an amino group, an alkylamino group, an imide group, a ureide group, a sulfamoylamino group, an alkoxycarbonylamino group, an aryloxycarbonylamino group, an alkoxycarbonyl group, an aryloxycarbonyl group and a carboxyl group can be mentioned.

l is preferably one or two, more preferably one.

m is preferably one, and n is preferably one or two, more preferably one.

As for the divalent linking group represented $L_1$, for example, an oxygen atom, a sulfur atom, an amido group, a sulfonamido group, an imido group, a carbamoyl group, an oxycarbonyl group and an oxycarbonylamino group can be mentioned. Among these, oxygen atom, an amido group and a sulfonamido group are preferable and an oxygen atom, an —$NR_5CO$— group and an —$NR_5SO_2$— group are more preferable. The concrete examples are —O—, —NHCO—, —$NHSO_2$—, —NHCOO— and —CONH.

A preferable example for $X_1$ is a chlorine atom.

A preferable example for $X_2$ is a chlorine atom.

As for the substituent represented by $R_{11}$, for example, a propanoylamino group, a butanoylamino group, a pentanoylamino group, a pivaloylamino group, a hexanoylamino group, a heptanoylamino group, an ethanesulfonamide group, a butanesulfonamide group, a hexanesulfonamide group, a p-toluenesulfonamide group, a succineimide group, a butylaminocarbonyl group, a pentylaminosulfonyl group, a hexyloxycarbonyl group and a pentyloxycarbonylamino group can be mentioned. Preferable number of carbon atoms contained in the substituent represented by $R_{11}$ is five to nine and as the substituent. An amide group, and a sulfonamide group are preferable.

$R_{12}$ represents a group selected from the group consisting of an alkyl group, an aryl group, and a heterocyclic group. The preferable example is an alkyl or aryl group which may have a substituent. Number of carbon atom of $R_{12}$ is preferably 12. Preferable example includes

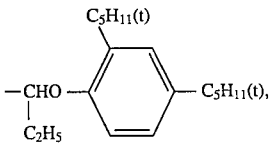

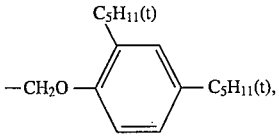

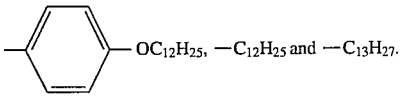

As for the substituent represented by $R_{13}$, which is substitutable on the benzene ring includes, for example, an alkyl group, a cycloalkyl group, an alkenyl group, an aryl group, an acylamino group, a sulfonamide group, an alkylthio group, an arylthio group, a halogen atom, a heterocyclic ring, a sulfonyl group, a sulfinyl group, a phosphonyl group, an acyl group, a carbamoyl group, a sulfamoyl group, a cyano group, an alkoxy group, an aryloxy group, a heterocyclicoxy group, a xyloxy group, an acyloxy group, a carbamoyloxy group, an amino group, an alkylamino group, an imide group, a ureide group, a sulfamoylamino group, an alkoxycarbonylamino group, an aryloxycarbonylamino group, an alkoxycarbonyl group, an aryloxycarbonylamino group, and a carboxyl group can be mentioned.

As for the divalent linking group represented $L_{11}$, for example, an oxygen atom, a sulfur atom, an amido group, a sulfonamido group, an imido group, a carbamoyl group, an oxycarbonyl group and an oxycarbonylamino group can be mentioned. Among these, oxygen atom, an amido group and a sulfonamido group are preferable and an oxygen atom, an —$NR_5CO$— group and an —$NR_5SO_2$— group are more preferable. The concrete example includes —O—, —NHCO—, —$NHSO_2$— and —CONH—.

o is preferably one, and p is preferably zero or one.

A preferable example for $X_{11}$ is a chlorine atom.

A preferable example for $X_{12}$ is a chlorine atom.

The coupler represented by formula M-1 is preferable because of producing a dye having high maximum density.

Typical examples of the magenta dye-forming coupler represented by the general formulae M-1 and M-2.

M1-1

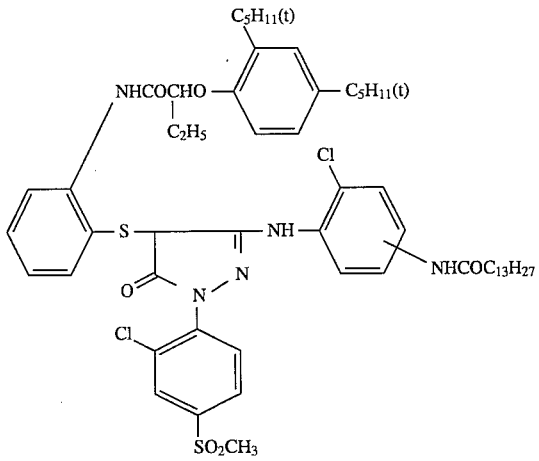

M1-2

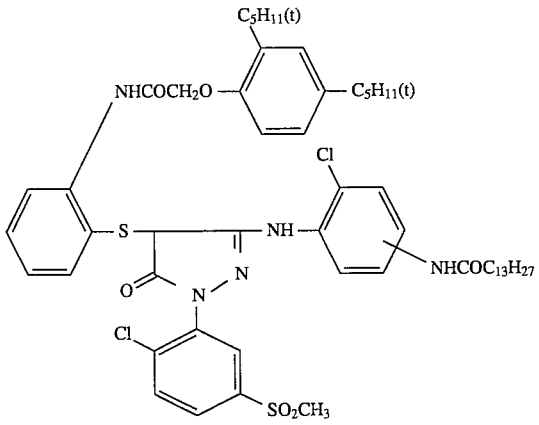

-continued
M1-3
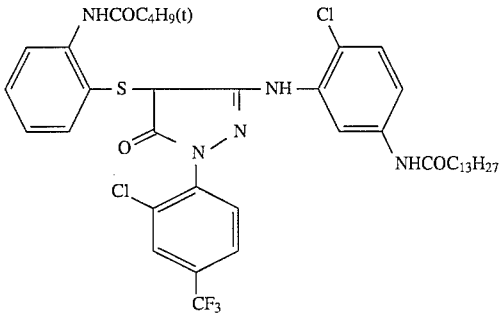
M1-4
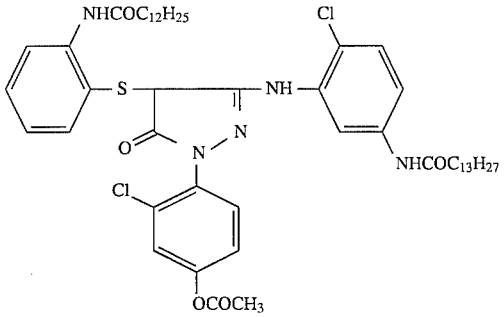
M1-5
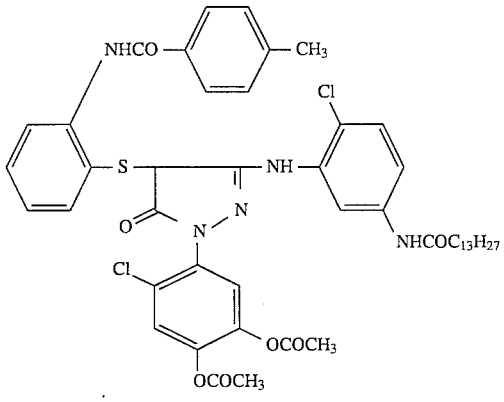
M1-6
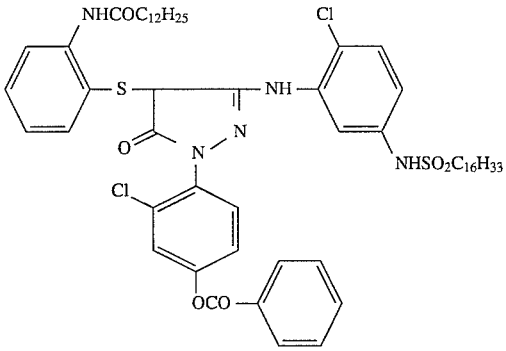
M1-7
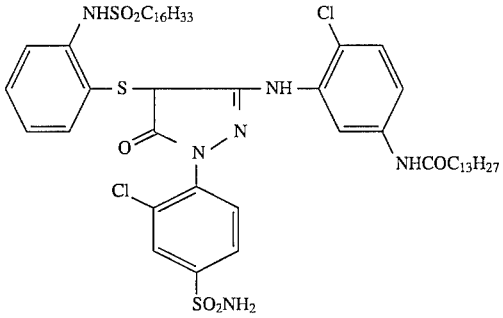

-continued
M1-8
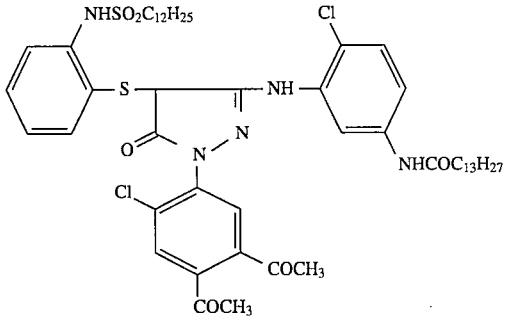
M1-9
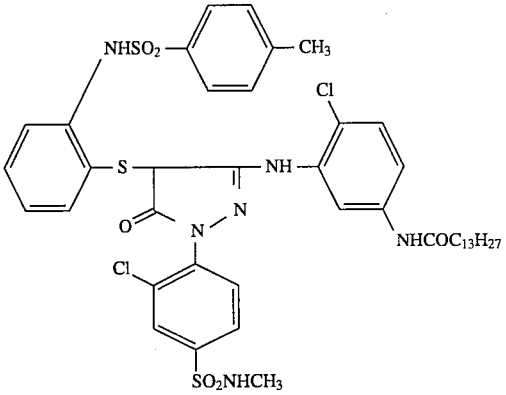
M1-10
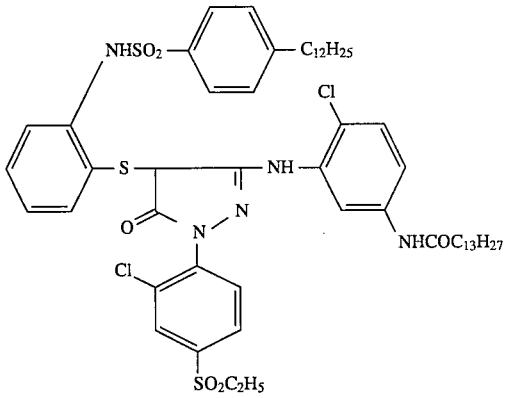
M1-11
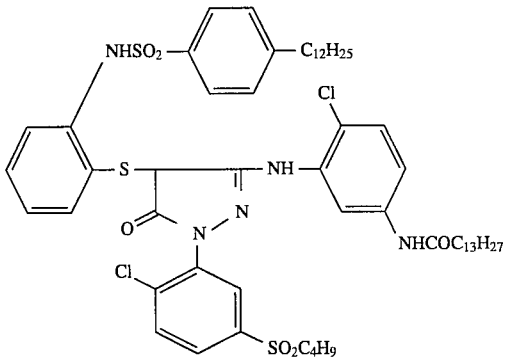

-continued
M1-12
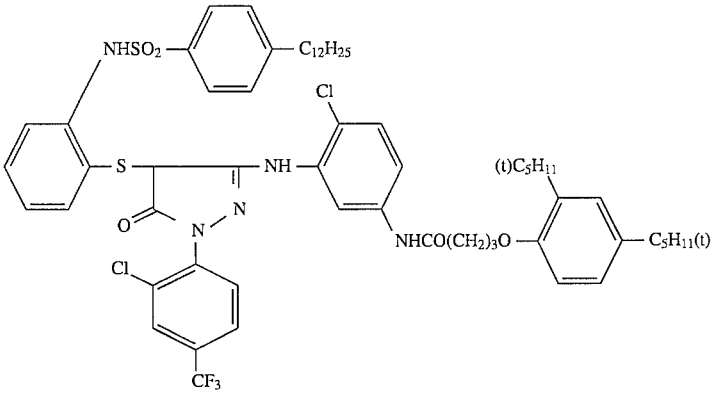
M1-13
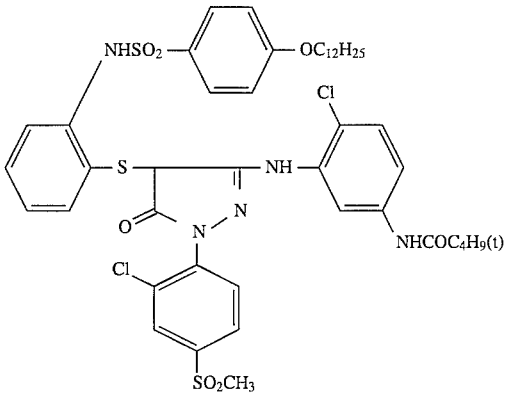
M1-14
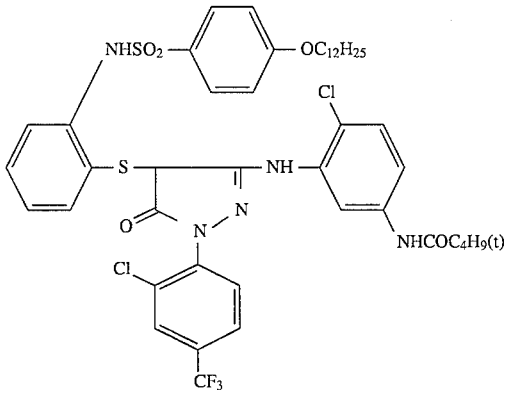
M1-15
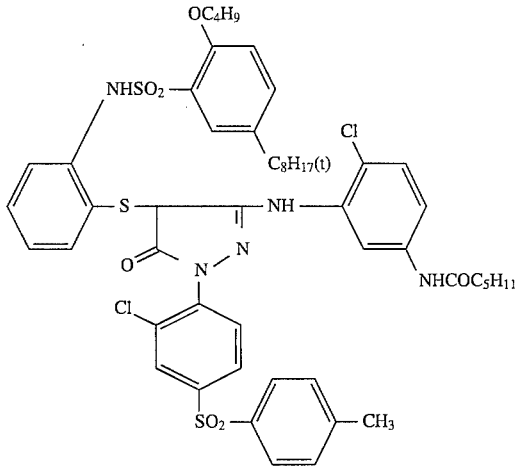

-continued
M1-16
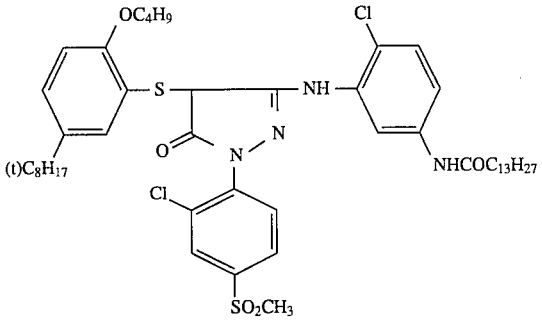
M1-17
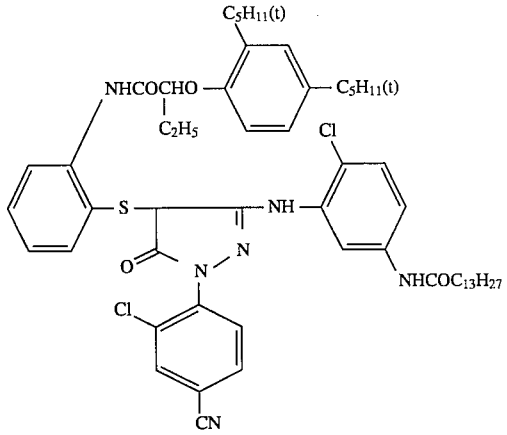
M1-18
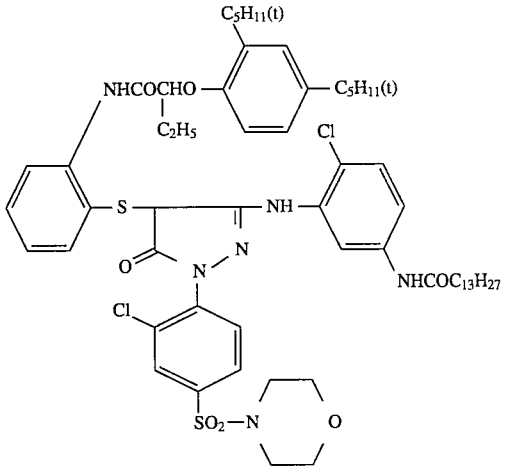
M1-19
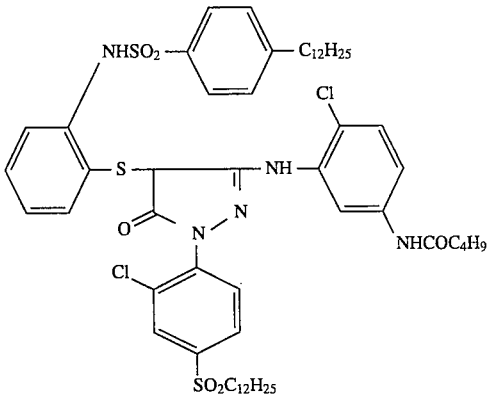

-continued
M1-20
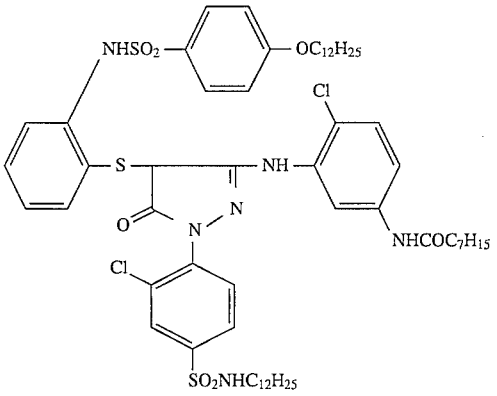
M1-21
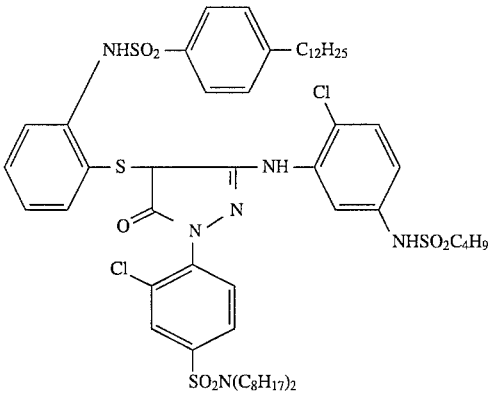
M1-22
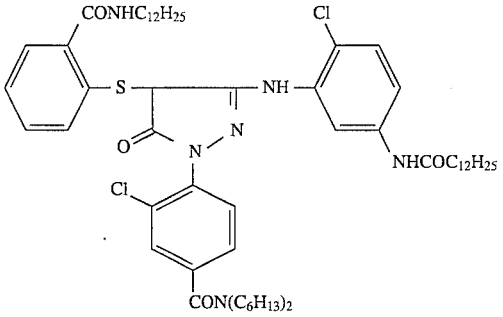
M1-23
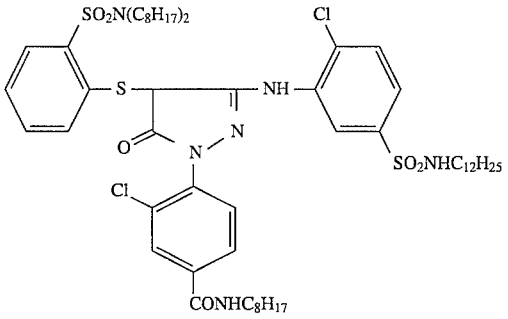

-continued
M1-23
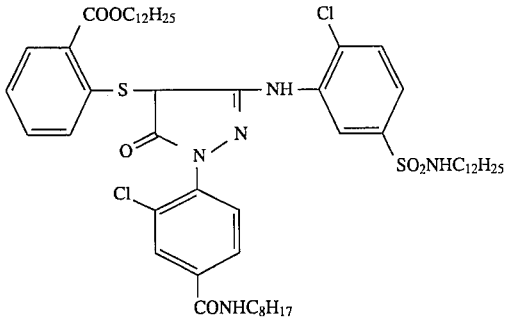
M1-24
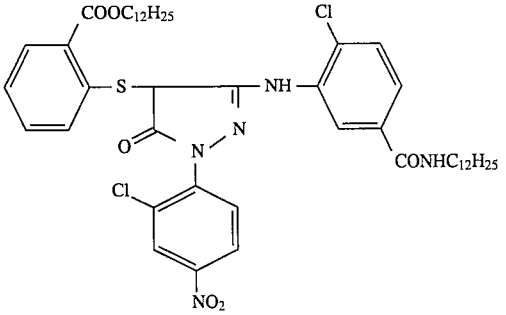
M1-25
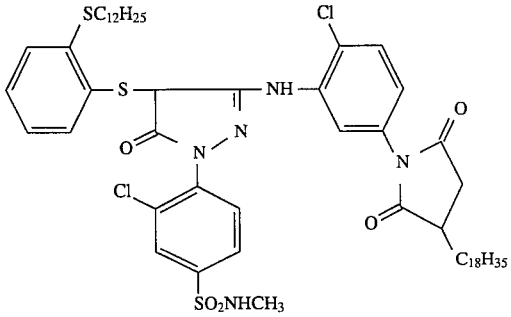
M1-26
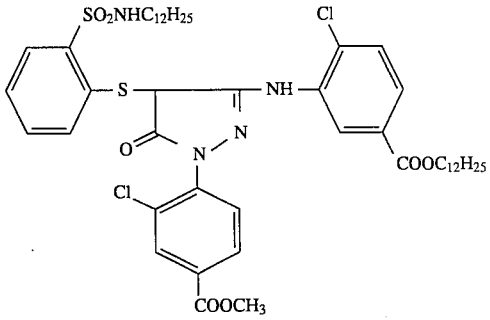
M2-1
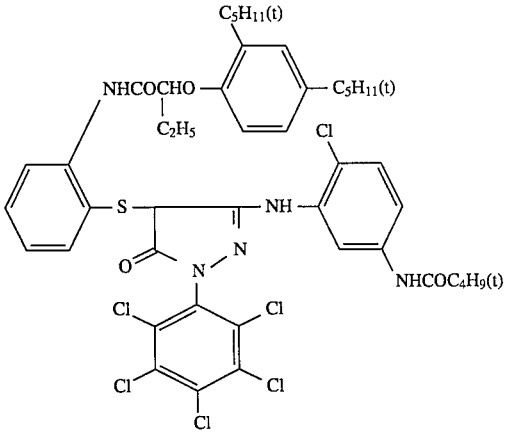

-continued
M2-2
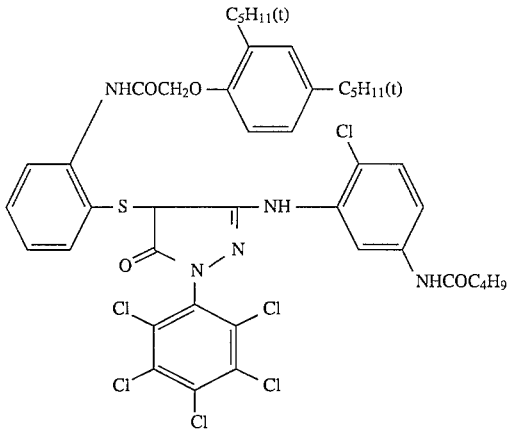
M2-3
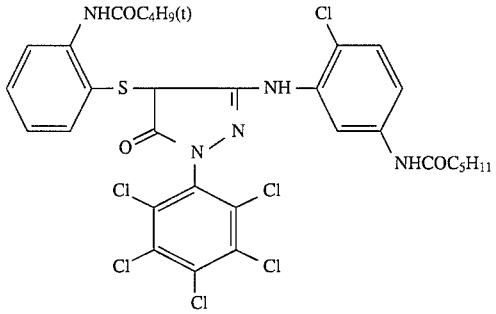
M2-4
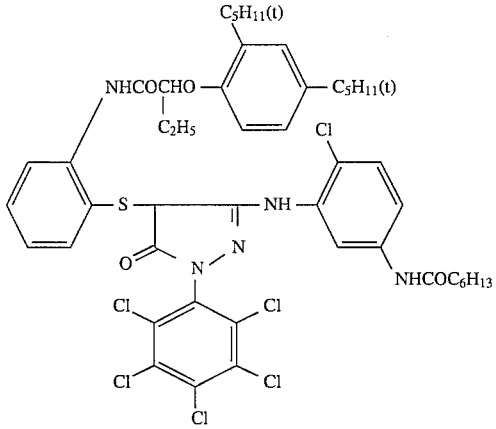
M2-5
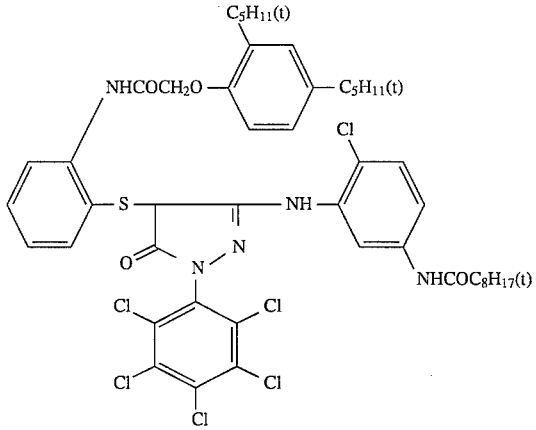

-continued
M2-6
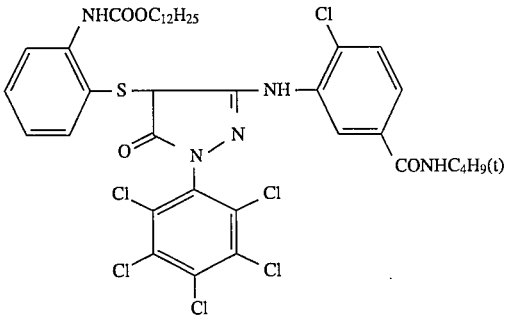
M2-7
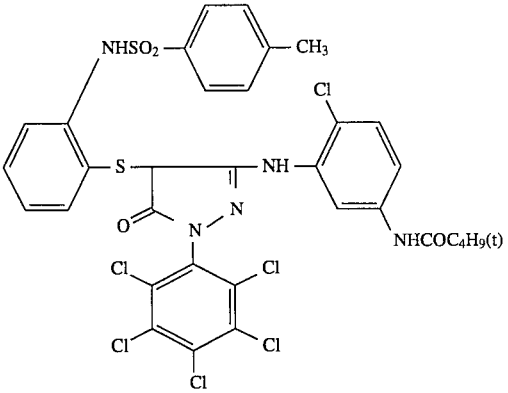
M2-8
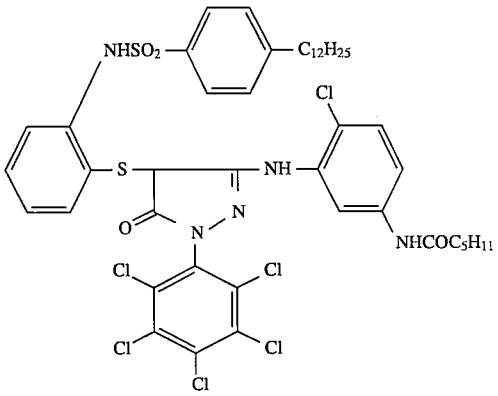
M2-9
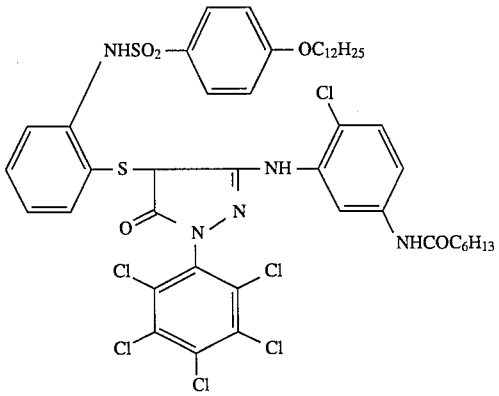

-continued
M2-10
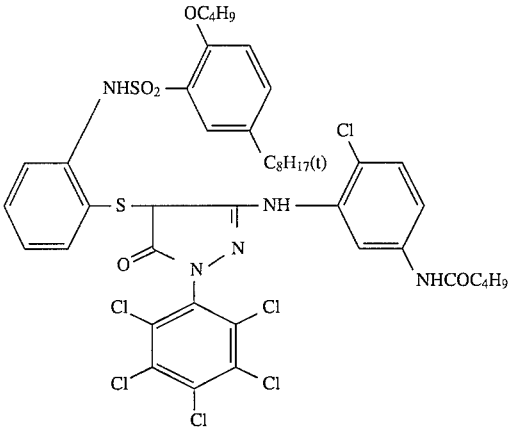
M2-11
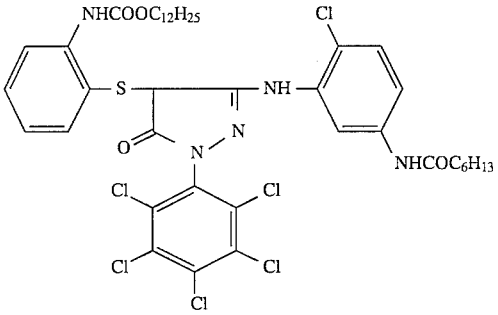
M2-12
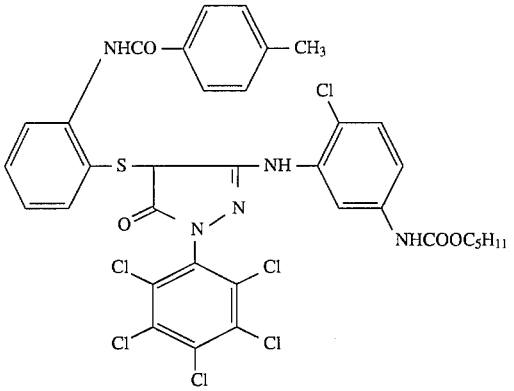
M2-13
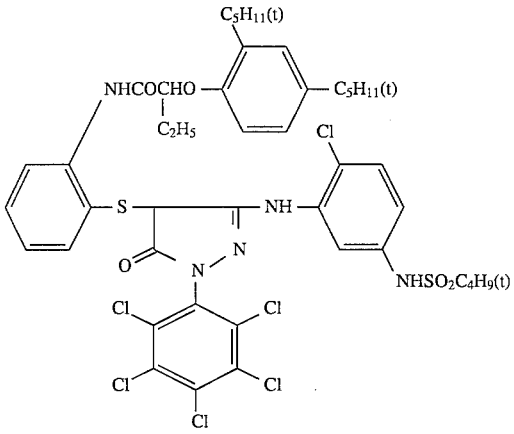

-continued
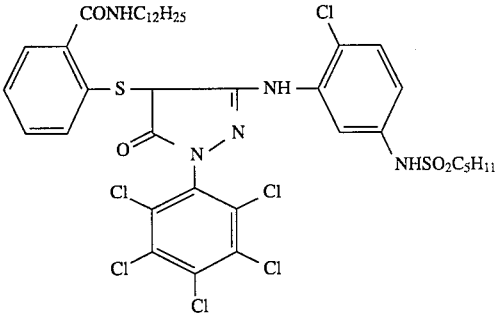
M2-14
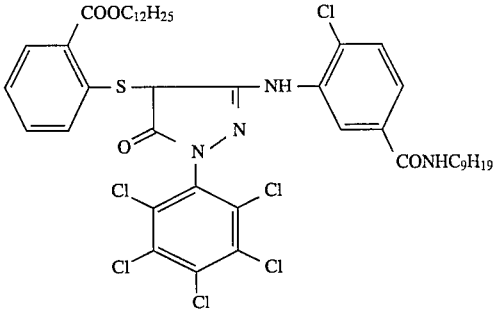
M2-15
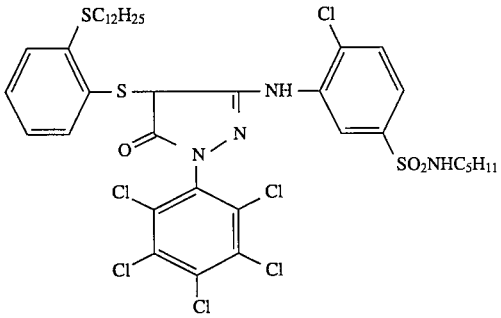
M2-16
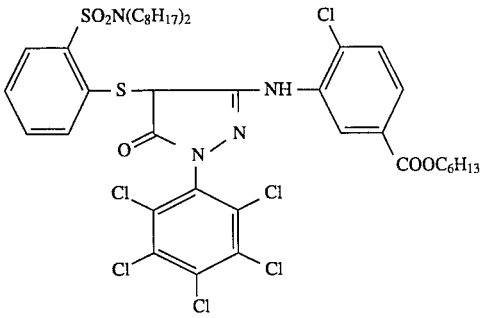
M2-17
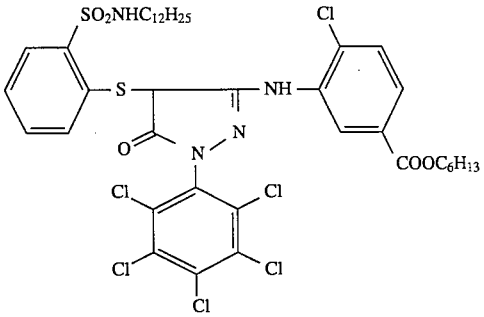
M2-18

-continued
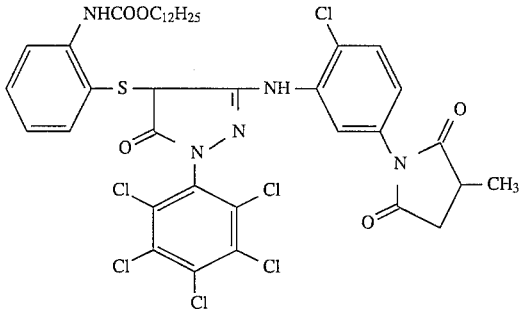
M2-19
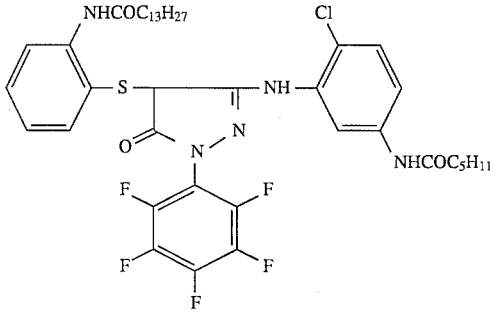
M2-20
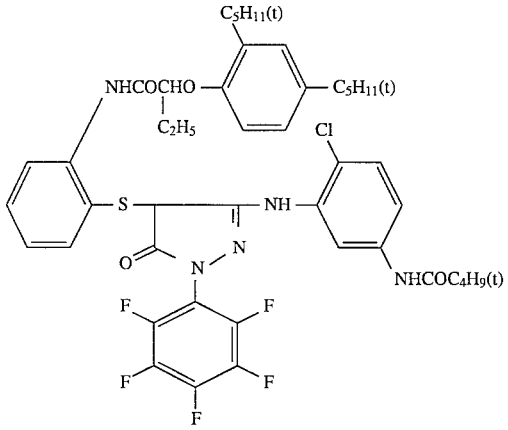
M2-21
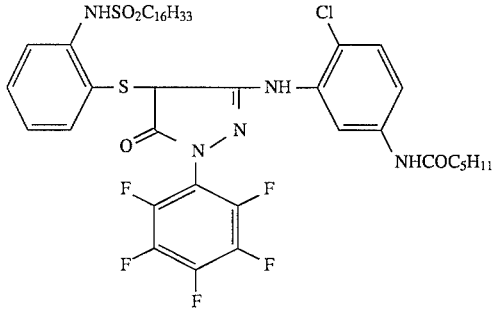
M2-22
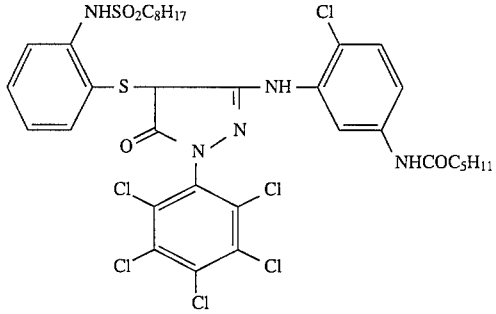
M2-23

Specific synthesis examples of the magenta dye-forming couplers represented by the general formulae [M-1] and [M-2] are explained. General method of synthesis is disclosed in, for example, U.S. Pat. Nos. 2,369,489, 2,376,380, 2,472,581, 2,600,788, 2,933,391 and 3,615,506; British Patents No. 956,261 and No. 1,134,320; Japanese Patent Publication No. 45-20636(1970) and Japanese Patent O.P.I. Publication No. 2-39148(1990).

Specific synthesis examples of the magenta dye-forming couplers represented by the general formulae[M-1] and [M-2] are given below:

Synthesis Example 1

Synthesis of the exemplified Compound M1-1

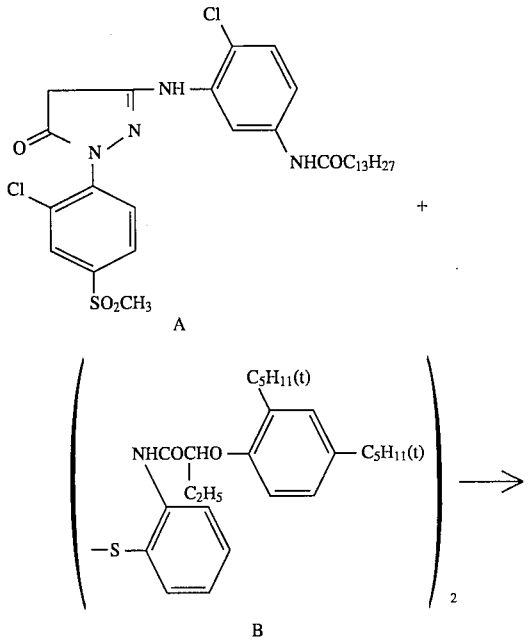

Exemplified Compound M1-1

Compound A in an amount of 2.67 g and 1.8 g of Compound B were dissolved in 12 ml of dimethylsulfonamide and heated to 80° to 90° C. To this solution, 0.34 g of bromine dissolved in 5 ml of dimethylsulfonamide was added dropwise and was heated for another two hours. After cooling down the solution to the room temperature, this was added to 100 ml of water, and the precipitated crystals were separated by filtration, washed and dried. Thus obtained crystal was recrystallized in 30 ml mixed solvent consisting of nitrile/toluene/, to obtain 2.4 g the exemplified Compound M1-1. This compound was identified as the Exemplified Compound M1-1 by Mass spectroscopy, N.M.R. spectroscopy, and I.R. spectroscopy.

Synthesis Example M2-1

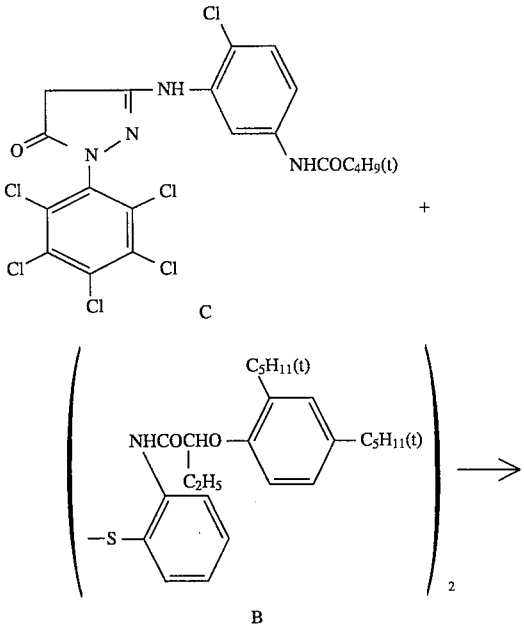

Exemplified Compound M2-1

2.4 g of Compound C and 1.8 g of Compound B were dissolved in 12 ml of dimethylsulfonamide and the solution was heated up to 80° to 90° C. To this solution, 0.34 g of bromine dissolved in 5 ml of dimethylsulfonamide was added dropwise spending for ten minutes and the mixture was heated for another two hours. After cooling down the solution to the room temperature, this was added to 100 ml of water, and the precipitated crystals were separated by filtration, washed and dried. Thus obtained crystal was recrystallized in 30 ml of nitrile, to obtain 2.3 g the exemplified Compound M2-1

(Melting point: 177.5° to 178.5° C.)

This compound was identified as the Exemplified Compound M2-1 by Mass spectroscopy, NMR spectroscopy, and I.R. spectroscopy.

The magenta dye-forming coupler of the present invention, which is represented by the general formula [M-1] or [M-2] is usually used at a quantity between 1×10–3 and 8×10–1 mols, and, more preferably between 1×10–2 and 8×10–1 mols a mol of silver halide.

The magenta dye-forming couplers represented by the general formulae [M-1] and/or [M-2] may be used in combination with another kind of coupler.

In order to incorporate the D.I.R. coupler used in the present invention in the hydrophilic colloidal layer of a light-sensitive color photographic layer, it is possible to apply a method, in which the coupler is first dissolved in a conventionally known high boiling-point solvent, such as dibutyl phthalate, tricresyl phosphate, di-nonylphenol, etc., or combination of the high boiling-point solvent and a low boiling-point solvent such as butyl acetate, propionic acid, etc. either singly or in combination, respectively. Then the coupler solution is mixed with an aqueous solution containing gelatin and a surface active agent. Subsequently, after the solution is subject to emulsification, using a high-speed rotary mixer, a colloid mill or a ultra-sonic homogenize, this is incorporated in the emulsion, either directly or after it being is set, cut and washed with water.

The magenta dye-forming coupler represented by the general formula [M-1] or [m-2] of the present invention may be added to a silver halide emulsion layer after being dispersed separately together with a high boiling-point solvent, however, it is preferable for both compounds to be dissolved simultaneously, dispersed and added to the emulsion.

The amount of the above-mentioned high boiling-point organic solvent is generally between 0.01 and 10 grams a gram of silver halide and, more preferably, between 0.1 and 3.0 grams.

As for silver halide emulsion used in the light-sensitive material of the present invention, any kind of silver halide emulsion which is known in the art can optionally be employed. The emulsion may undergo a conventional chemical sensitization, and can be spectrally sensitized with a conventional sensitizing dye, to make the emulsion sensitive to lights of any pre-designed spectral region. The silver halide emulsion can comprise one or more kinds of photographic additives such as an anti-foggant, a stabilizer, etc. As for the binder for the emulsion, it is advantageous to use gelatin.

The silver halide emulsion layer and other hydrophilic colloidal layer may be hardened and comprise a plasticizer and a dispersion containing a polymer which is insoluble or sparsely soluble in water. Dye-forming coupler is used in the silver halide emulsion layer of the light-sensitive color photographic material of the present invention.

It is also possible to use a colored coupler, which functions a color compensator, a competing coupler, a compound which is, upon reaction with an oxidation product of a color developing agent capable of releasing a photographically useful fragment such as a development accelerator, a bleach accelerator, a developing agent, a solvent for the silver halide, a color toning agent, a hardener, a fogging agent, an anti-foggant, a chemical sensitizer, a spectral sensitizer, a desensitizing agent, etc.

As for the support, for example, paper laminated with a polymer such as polyethylene, a polyethyleneterephthalate film, a baryta paper and a cellullose triacetate may be used.

In order to obtain a dye image using the light-sensitive material of the present invention, color photographic process which is generally known in the art may be applied.

EXAMPLES

Hereinbelow the present invention is further explained with reference to working examples, however, the scope of the present invention is not limited by them.
(0069)

Example 1

In all of the following examples, the amount of addition of the additive in the silver halide light-sensitive photographic material is given, unless defined otherwise, in terms of weight a square meter of the light-sensitive material. As to the amounts of silver halide and colloidal silver, they are shown in terms of amount of silver converted therefrom.

One surface of a triacetylcellulose film support was subjected to subbing treatment and, then, the opposite surface thereof with respect to the support, following layers, the components of which are given below, were coated in this order from the support, to prepare a photographic support with subbing treatment. Amount of addition was given in terms of weight a square meter of the support.

First Layer (Rear Surface)
Alumina Sol AS-1009 aluminum oxide) 0.1 g (a product of Nissan Chemical Industries Co., Ltd.)
Diacetyl cellulose 0.2 g
Second layer (Rear Surface)
Diacetyl cellulose 100 mg
Stearic acid 10 mg
Fine powder of silica (Average diameter: 0.2 mm 50 mg On a triacetylcellulose film support, the following layers, the components of which are given below, are provided in order, to prepare multi-layer silver halide light-sensitive photographic material(Sample No. 1).

First Layer: Anti-Halation Layer (HC)
Black colloidal silica 0.15
UV-absorbent (UV-1) 0.20
Compound (CC-1) 0.02
High boiling-point solvent (Oil-1) 0.20
High boiling-point solvent (Oil-2) 0.20
Gelatin 1.6
Second Layer: Intermediate Layer (IL-1)
Gelatin 1.3
Third Layer: Low red light-sensitive silver halide emulsion layer (R-L)
Silver iodobromide emulsion: (average diameter: 0.3 mm; average
AgI content: 2.0 mol %) 0.4
Silver iodobromide emulsion: (average diameter: 0.4 mm; average AgI
content: 8.0 mol %) 0.3
Sensitizing Dye (S-1) $3.2\times10^{-4}$
Sensitizing Dye (S-2) $3.2\times10^{-4}$
Sensitizing Dye (S-3) $0.2\times10^{-4}$
Cyan Dye-Forming Coupler (C-1) 0.50
Cyan Dye-Forming Coupler (C-2) 0.13
Colored cyan Coupler (CC-1) 0.07
DIR Compound (D-1) 0.07
DIR Compound (D-1) 0.006
DIR Compound (D-2) 0.01
High boiling-point solvent (oil-1) 0.55
Gelatin 1.0
Fourth Layer: High red light-sensitive silver halide emulsion layer (R-H)
Silver iodobromide emulsion: (average diameter: 0.7 mm; average
AgI content: 7.5 mol %) 0.9
Sensitizing Dye (S-1) $1.7\times10^{-4}$
Sensitizing Dye (S-2) $1.6\times10^{-4}$
Sensitizing Dye (S-3) $0.1\times10^{-4}$
Cyan Dye-Forming Coupler (C-2) 0.23
Colored cyan Coupler (CC-1) 0.03
DIR Compound (D-2) 0.02
High boiling-point solvent (oil-1) 0.25
Gelatin 1.0
Fifth Layer: Intermediate Layer (IL-2)
Gelatin 0.8
Sixth Layer: LOW green light-sensitive silver halide emulsion layer (G-L)
Silver iodobromide emulsion: (average diameter: 0.3 mm; average
AgI content: 2.0 mol %) 0.4
Silver iodobromide emulsion: (average diameter: 0.4 mm; average
AgI content: 8.0 mol %) 0.6
Silver iodobromide emulsion: (average diameter: 0.3 mm; average AgI content: 2.0 mol %) 0.2
Sensitizing Dye (S-4) $7.7\times10^{-4}$
Sensitizing Dye (S-5) $0.8\times10^{-4}$
Magenta Dye-Forming Coupler (M-a) 0.35
Colored Magenta Coupler (CM-1) 0.05
DIR Compound (D-3) 0.02
High Boiling-Point Solvent 0.7
Gelatin 1.0
Seventh Layer: High green light-sensitive silver halide emulsion layer (G-H)
Silver iodobromide emulsion: (average diameter: 0.7 mm; average
AgI content: 7.5 mol %) 0.9
Sensitizing Dye (S-6) $1.1\times10^{-4}$
Sensitizing Dye (S-7) $2.0\times10^{-4}$
Sensitizing Dye (S-8) $1.3\times10^{-4}$
Magenta Dye-Forming Coupler (M-a) 0.20
Colored Magenta Coupler (CM-1) 0.02
DIR Compound (D-3) 0.004
High Boiling-Point Solvent (oil-2) 0.35
Gelatin 1.0
Eighth Layer: Yellow Filter Layer (YC)
Yellow colloidal Silver 0.1
Additive (SC-1) 0.12
High Boiling-Point Solvent (oil-2) 0.15
Gelatin 1.0
Ninth Layer: Low blue light-sensitive silver halide emulsion layer (B-L)
Silver iodobromide emulsion: (average diameter: 0.3 mm; average
AgI content: 2.0 mol %) 0.25
Silver iodobromide emulsion: (average diameter: 0.4 mm; average
AgI content: 8.0 mol %) 0.25
Sensitizing Dye (S-9) $5.8\times10^{-4}$
Yellow Dye-Forming Coupler (Y-1) 0.6
Yellow Dye-Forming Coupler (Y-2) 0.32
DIR Compound (D-1) 0.003
DIR Compound (D-2) 0.006
High Boiling-Point Solvent (oil-2) 0.18
Gelatin 1.3
Tenth layer: High blue light-sensitive silver halide emulsion layer (B-H)
Silver iodobromide emulsion: (average diameter: 0.8 mm; average
AgI content: 8.5 mol %) 0.5
Sensitizing Dye (S-10) $3\times10^{-4}$
Sensitizing Dye (S-11) $1.2\times10^{-4}$
Yellow Dye-Forming Coupler (Y-1) 0.18
Yellow Dye-Forming Coupler (Y-2) 0.10
High Boiling-Point Solvent (oil-2) 0.05
Gelatin 1.0
Eleventh Layer: First Protective Layer
Silver iodobromide emulsion (average diameter: 0.08 mm) 0.3
UV Absorbent (UV-1) 0.07
UV Absorbent (UV-2) 0.10
High Boiling-Point Solvent (Oil-1) 0.07
High Boiling-Point Solvent (Oil-3) 0.07
Gelatin 0.8
Twelfth Layer: Second Protective Layer (PRO-2)
Compound A 0.04
Compound B 0.004
Polymethylmethacrylate (Average Grain Size: 3 mm) 0.02
Copolymer of Methylmethacrylate/Ethylacrylate/Methacrylic acid (3:3:8 by weight; Average Grain Size; 3 mm) 0.13
Gelatin 0.5

Respective layers contain, in addition to those components mentioned above, compounds Su-1 and Su-2; a viscosity adjusting agent, gelatin hardener H-1, and a stabilizing agent ST-1, anti-foggants AF-1 and AF-2, of which weight average molecular weights are 10,000 and 1,100,000, respectively and dyes AI-1 and AI-2.

C-1

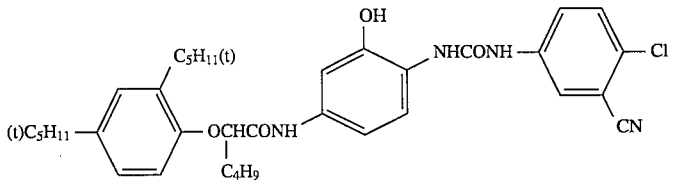

C-2

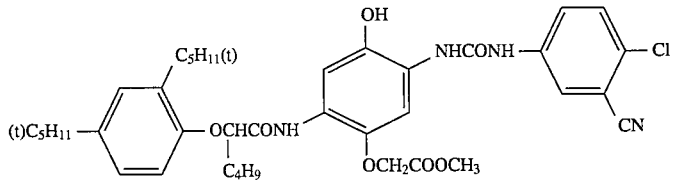

(Coupler for Comparison)

M-a

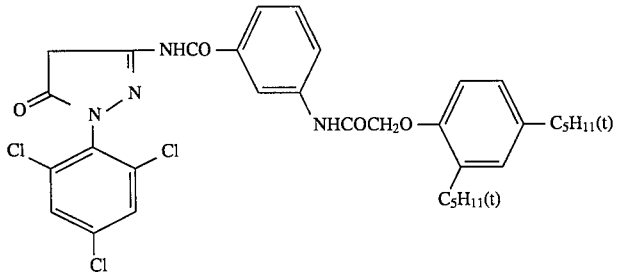

-continued
CM-1
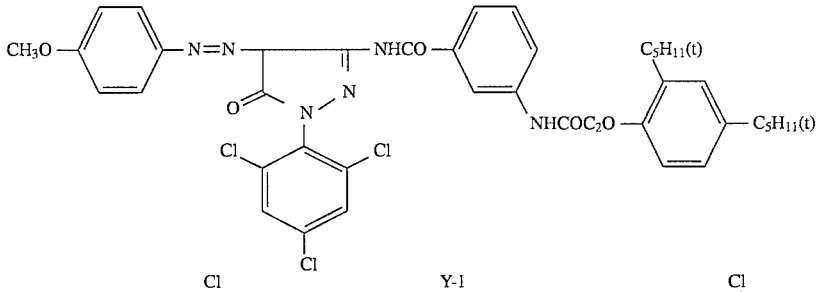
Y-1
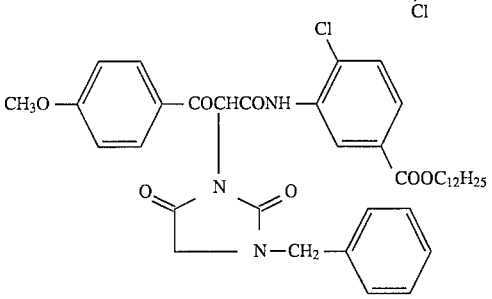
Y-2
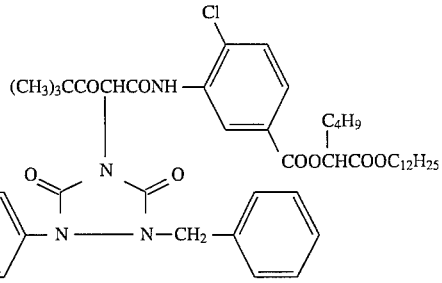
CC-1
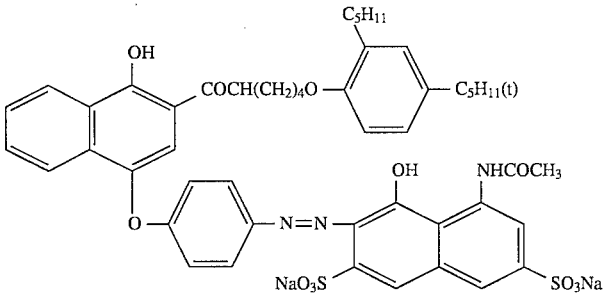
D-1
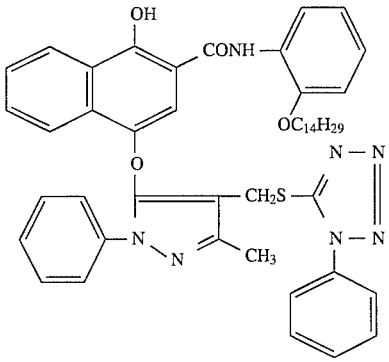
D-2
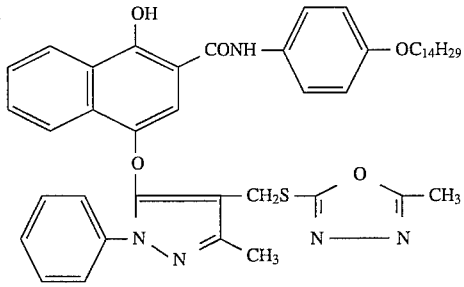
D-3
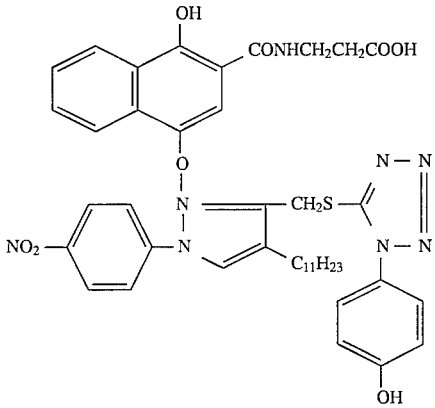
UV-1
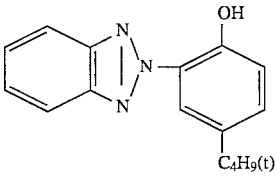

-continued
UV-2
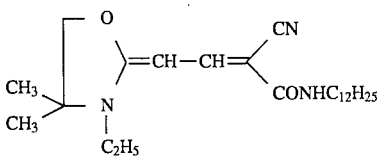
Mixture of
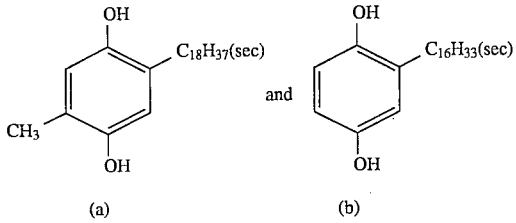
at a mixing ratio of (a):(b) = 2:3
SC-1
Oil-1
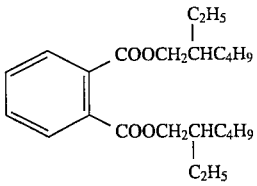
Oil-2
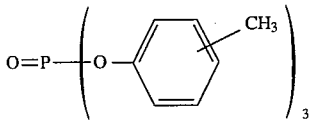
Oil-3
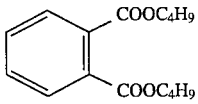
Compound A
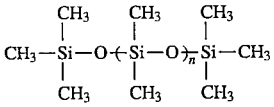
(weight average molecular weight Mw: 3,000
Compound B
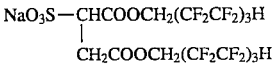
SU-1
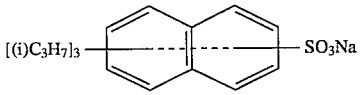
SU-2
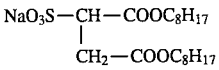
S-1
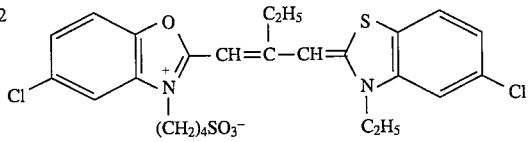
S-2
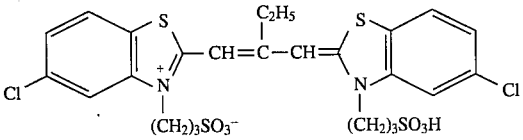
S-3
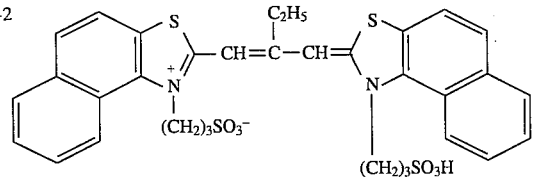
S-4
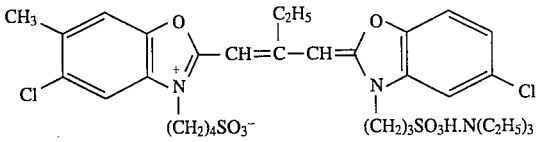
S-5
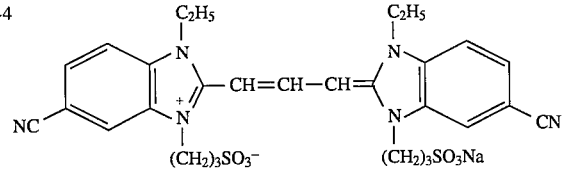
S-6
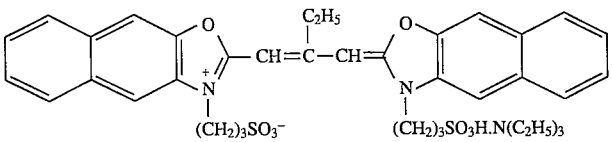
S-7
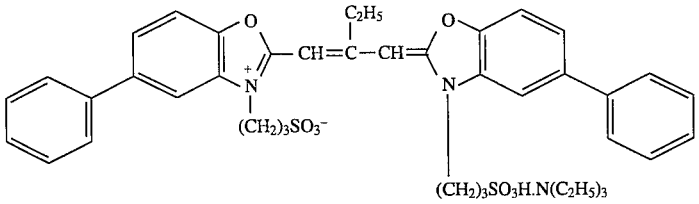

-continued
S-8
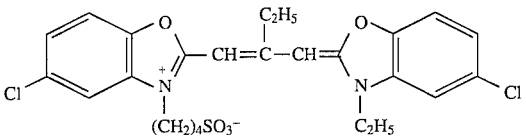
S-9
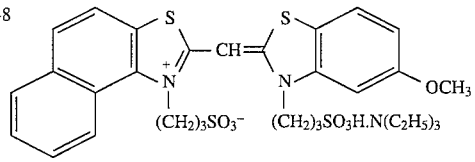
S-10
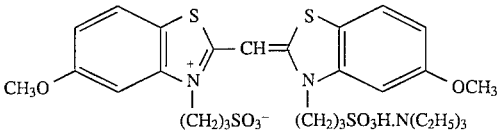
S-11
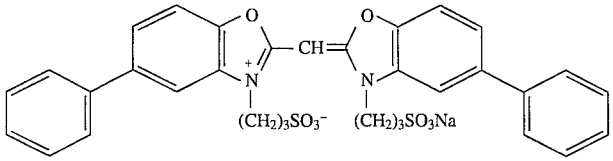
H-1
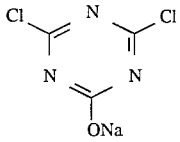
ST-1
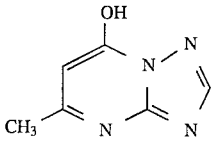
DI-1
Mixture of
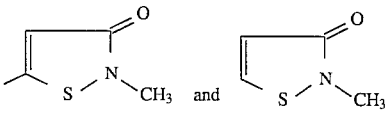
AF-1
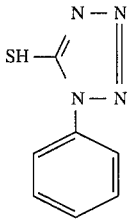
AF-2
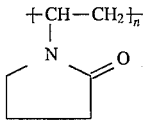
$\overline{Mw}$: 9,000
AI-1
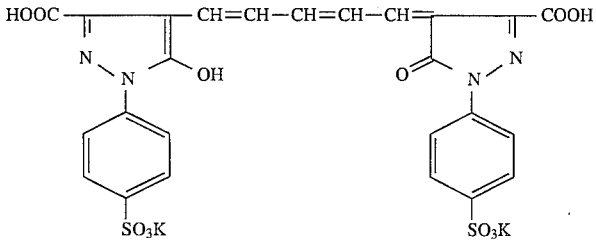
AI-2
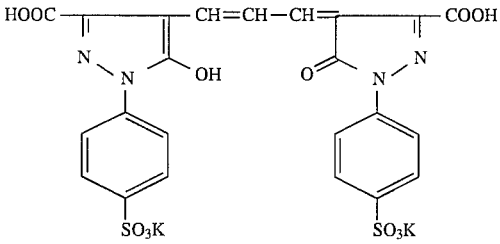
Next, in the above-mentioned Sample 1, the magenta dye-forming coupler used in the sixth and the seventh layers is replaced with those as shown in the Table 2 below, thus to prepare Sample Nos. 2 to 27.

The amount of the magenta dye-forming couplers added to Sample Nos. 2 to 27 was the equivalent mols used in Sample No. 1.

(Comparative Coupler) M-b

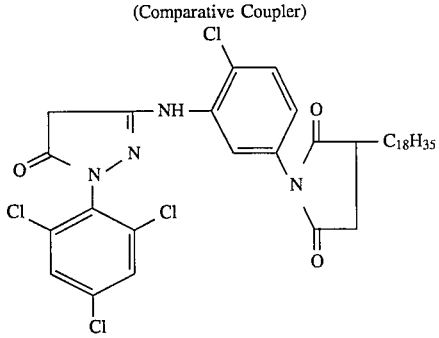

(Comparative Coupler) M-c

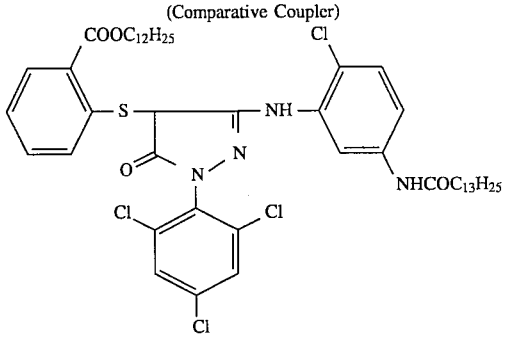

Respective Sample Nos. 1 to 27, thus prepared were subjected to exposure to green light through an optical step-wedge and processed under the following conditions.

Processing Step:

TABLE 1

| Processing Step | Processing Period | | Processing Temperature (°C.) | Amount of Replenishment (cc) |
|---|---|---|---|---|
| Color Development | 3 minutes | 15 seconds | 38 ± 0.3 | 780 |
| Bleaching | | 45 seconds | 38 ± 2.0 | 150 |
| Fixing | 1 minutes | 30 seconds | 38 ± 2.0 | 830 |
| Stabilizing | | 60 seconds | 38 ± 5.0 | 830 |
| Drying | 1 minute | | 55 ± 5.0 | — |

Note:) In the Table 1, the amount of replenishment is a value a square meter of light-sensitive photographic material.

Compositions of the color developing solution, the bleaching solution, the fixing solution, the stabilizing solution and the replenishing solutions thereof are given below:

Color Developing Solution
Water 800 ml
Potassium carbonate 30 g
Sodium hydrogencarbonate 2.5 g
Potassium sulfite 3.0 g
Sodium bromide 1.3 g
potassium iodide 1.2 mg
Hydroxylamine sulfate 2.5 g
Sodium chloride 0.6 g
4-Amino-3-methyl-N-ethyl-N-(b-hydroxyethyl) aniline sulfate 4.5 g
Diethylenetriamine penta-acetic acid 3.0 g
Potassium hydroxide 1.2 g Add water to make the total volume one liter and adjusted pH of the solution with potassium hydroxide or 20% sulfuric acid at 10.06.

Color Developing Replenisher
Water 800 ml
Potassium carbonate 35 g
Sodium hydrogencarbonate 3 g
Potassium sulfite 5 g
Sodium bromide 0.4 g
Hydroxylamine sulfate 3.1 g
4-Amino-3-methyl-N-ethyl-N-(b-hydroxyethyl) aniline sulfate 6.3 g
Potassium hydroxide 2 g
Diethylenetriamine penta-acetic acid 3.0 g Add water to make the total volume one liter and adjusted pH of the solution with potassium hydroxide or 20% sulfuric acid at 10.18.

Bleaching solution
Water 700 ml
Ferric ammonium of 1,3-diaminopropane-tetra-acetate 125 g
Ethylenediaminetetracetic-acetic acid 2 g
Sodium nitrate 40 g
Ammonium bromide 150 g
Glacial acetic acid 40 g Add water to make the total volume one liter and adjusted pH of the solution with aqueous ammonia or glacial acetic acid at 4.4.

Bleach Replenisher
Water 700 ml
Ferric ammonium of 1,3-diaminopropane-tetra-acetate 175 g
Ethylenediaminetetracetic-acetic acid 2 g
Sodium nitrate 50 g
Ammonium bromide 200 g
Glacial acetic acid 56 g Add water to make the total volume one liter and adjusted pH of the solution with aqueous ammonia or glacial acetic acid at 4.0.

Fixing Solution
Water 800 ml
Ammonium thiocyanate 120 g
Ammonium thiocyanate 150 g
Sodium sulfite 15 g
Ethylenediamine tetra-acetic acid 2 g Add water to make the total volume one liter and adjusted pH of the solution with glacial acetic acid or aqueous ammonia at 6.2.

Fixing Replenisher
Water 800 ml
Ammonium thiocyanate 150 g
Ammonium sulfite 180 g
Sodium sulfite 20 g
Ethylenediamine tetra-acetic acid 2 g Add water to make the total volume one liter and adjusted pH of the solution with glacial acetic acid or aqueous ammonia at 6.5.

Stabilizing Solution and Replenisher thereof
Water 900 ml
$P—C_8H_{17}—C_6H_4—O—(CH_2CH_2O)_{10}H$ 2.0 g
Dimethylol urea 0.5 g
Hexamethylene tetramine 0.2 g
1,2-benzisothiazoline-3-one 0.1 g
Siloxane(made by UCC; L-77) 0.1 g
Aqueous ammonia 0.5 ml Add water to make the total volume one liter and adjusted pH of the solution with aqueous ammonia or 50% sulfuric acid at 8.5.

Sensitometric characteristics of the respective samples with respect to green light measurements were evaluated.

Sensitivity of the samples was calculated from a reciprocal of the amount of exposure necessary to give fog density plus 0.3 and was shown in the following Table 2 as relative sensitivity when the sensitivity of Sample 1 is normalized as 100.

Further color reproduction property with respect to Samples 1 to 27 was evaluated in the following manner; First, using respective samples and a camera (Konica FT-1 MOTOR; a product of Konica Corporation), a color checker, a product of Macbeth Limited, was taken. Subsequently the samples were subjected to color negative developing process (CNK-4: a product of Konica Corporation) and using color negative images thus obtained, positive printing images were obtained on Konica Color paper Type QA by the use of Konica Color Printer CL-P2000, a product of Konica Corporation, with the printing size of 82 mm×117 mm, upon carrying out printing, the printing conditions were adjusted with respect to the respective samples so that gray color on the color checker may be gray on the print. Then color reproduction property was evaluate by visual observation.

Results are shown in Table 2.

Still further, with respect to Sample Nos. 1 to 27, treatment with formalin and evaluation of storage property before exposure were carried out and the results are given in Table 2.

[Treatment with Formalin]

In the bottom of a sealed box, a solution prepared by adding 6 ml of an aqueous formaldehyde solution to 300 ml of 35% aqueous solution of glycerine was placed. The samples were stored for three days at 35° C. in the atmosphere, in which equilibrium with this is maintained.

[Numerical Formula]

Residual ratio of Magenta Density=(Maximum magenta Density of Formalin-Treated Sample)/(Maximum Magenta Density of Frozen Sample)×100

[Evaluation of preservation property before exposure]

Samples Nos. 1 to 27, which were subjected to compulsory deterioration test by being placed for eight days in the atmospheric conditions at 40° C., 80% R. H., were exposed and processed in the same manner as mentioned above. Next, relative sensitivity of the green-sensitive layer of these samples were measured and compared with the sensitivity of the samples which are not subjected to the compulsory deterioration test, which is normalized as 100.

TABLE 2

| | Sixth and Seventh Layers | | | | |
|---|---|---|---|---|---|
| Sample No. | Coupler | Sensitivity | Color Reproduction* | Residual ratio of Magenta Density | Preservation before Exposure (Relative Sensitivity) |
| 1 | M-a | 100 | A | 40 | 82 |
| 2 | M-b | 105 | C | 31 | 73 |
| 3 | M-c | 140 | C | 90 | 80 |
| 4 | M1-1 | 161 | A | 95 | 94 |
| 5 | M1-2 | 159 | A | 94 | 93 |
| 6 | M1-4 | 152 | A | 92 | 91 |
| 7 | M1-8 | 159 | A | 94 | 93 |
| 8 | M1-10 | 160 | A | 94 | 94 |
| 9 | M1-11 | 160 | A | 94 | 94 |
| 10 | M1-13 | 159 | A | 93 | 93 |
| 11 | M1-14 | 160 | A | 94 | 93 |
| 12 | M1-16 | 160 | A | 93 | 94 |
| 13 | M1-18 | 159 | A | 94 | 93 |
| 14 | M1-22 | 149 | A | 92 | 90 |
| 15 | M1-24 | 148 | A | 91 | 90 |
| 16 | M1-25 | 148 | A | 90 | 91 |
| 17 | M2-1 | 163 | A | 95 | 94 |
| 18 | M2-2 | 162 | A | 94 | 94 |
| 19 | M2-4 | 161 | A | 95 | 94 |
| 20 | M2-6 | 153 | A | 92 | 92 |
| 21 | M2-8 | 162 | A | 94 | 93 |
| 22 | M2-9 | 162 | A | 93 | 95 |
| 23 | M2-11 | 153 | A | 93 | 90 |
| 24 | M2-13 | 163 | A | 94 | 94 |
| 25 | M2-14 | 151 | A | 90 | 90 |
| 26 | M2-15 | 149 | A | 89 | 90 |
| 27 | M2-16 | 152 | A | 89 | 91 |

Note *) Visual evaluation by ten standard observers.
A: Good
B: Fair
C: Poor

As obvious from Table 2, Sample Nos. 1 and 2, in which comparative couplers are used, show relatively low sensitivity and big sensitivity lowering by storage under high temperature and high humidity conditions and density fall by formalin treatment. Whereas, Sample Nos. 3 to 26, in which couplers according to the present invention are used, show good color reproduction property, having enhanced sensitivity with slight sensitivity by storage under high temperature and high humidity conditions as well as slightest density fall by formalin treatment.

According to the present invention, it is possible to provide a silver halide light-sensitive color photographic material, which has, firstly, enhanced sensitivity and excellent color reproduction property when printed; secondly improved resistance against formalin gas and, thirdly, improved storage preservation property before exposure.

I claim:

1. A silver halide light-sensitive color photographic material which comprises a coupler represented by formula M-II

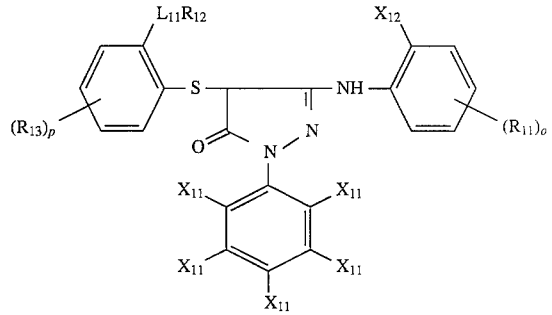

wherein, $R_{11}$ represents a group selected from the group consisting of an amide group, an amido group, a sulfonamide group, an imide group, a carbamoyl group, a sulfamoyl group, an oxycarbonyl group, an oxycarbonylamino group and a ureide group, each of which has not more than 10 carbon atoms; $R_{12}$ represents a group selected from the group consisting of an alkyl group, an aryl group, and a heterocyclic group; $R_{13}$ represents a group which can be substituted on a benzene ring; $X_{11}$ represents a halogen atom; $X_{12}$ represents a halogen atom or an alkoxy group; $L_{11}$ represents an atom or a group selected from the group consisting of an oxygen atom, a sulfur atom, a —$NR_{14}$ group, a —$SO_2$ group, a —$NR_{14}CO$— group, a —COO— group, a —$NR_{14}SO_2$— group, a —NH- COO— group, —CONH— group, and a —$NR_{14}CONR_{14}$— group; $R_{14}$ represents a hydrogen atom, an alkyl group, an aryl group, or a heterocyclic group; o represents an integer of one, two or three; and p represents an integer of zero to four.

2. A silver halide light-sensitive color photographic material of claim 1, wherein $X_{11}$ is a chlorine atom.

3. A silver halide light-sensitive color photographic material of claim 1, wherein $X_{12}$ is a chlorine atom.

4. A silver halide light-sensitive color photographic material of claim 1, wherein, $L_{11}$ is oxygen atom, an amido group or a sulfonamido group.

5. A silver halide light-sensitive color photographic material of claim 1, wherein $L_{11}$ is —O—, —NHCO—, —$NHSO_2$— or —CONH—.

6. A silver halide light-sensitive color photographic material of claim 1, wherein $R_{11}$ is a propanoylamino group, a butanoylamino group, a pentanoylamino group, a pivaloylamino group, a hexanoylamino group, a heptanoylamino group, an ethanesulfonamide group, a butanesulfonamide group, a hexanesulfonamide group, a p-toluenesulfonamide group, a succineimide group, a butylaminocarbonyl group, a pentylaminosulfonyl group, a hexyloxycarbonyl group or a pentyloxycarbonylamino group each of which has five to nine carbon atoms.

* * * * *